United States Patent [19]

Henkel

[11] 3,972,670

[45] Aug. 3, 1976

[54] PRESS FOR MAKING CASTINGS OF POWDER OR GRANULAR MATERIALS

[75] Inventor: Ernst August Wilhelm Henkel, Selb, Germany

[73] Assignee: Gebruder Netzsch, Maschinenfabrik, Selb, Bayern, Germany

[22] Filed: May 20, 1975

[21] Appl. No.: 579,067

[30] Foreign Application Priority Data

May 22, 1974 Germany ..... 2424802
May 22, 1974 Germany ..... 2424803

[52] U.S. Cl. ..... 425/355; 425/78
[51] Int. Cl.[2] ..... B30B 11/02; B30B 15/14
[58] Field of Search ..... 425/78, 352, 355, DIG. 35, 425/18

[56] References Cited

UNITED STATES PATENTS

| | | | |
|---|---|---|---|
| 1,659,077 | 2/1928 | Bishop | 425/355 X |
| 1,806,300 | 5/1931 | Lemming | 425/78 X |
| 2,499,980 | 3/1950 | Stokes et al. | 425/78 |
| 3,172,182 | 3/1965 | Assmann | 425/78 |
| 3,559,243 | 2/1971 | Hermes | 425/78 |
| 3,664,784 | 5/1972 | Sibley | 425/78 |
| 3,687,586 | 8/1972 | Hara et al. | 425/78 |

*Primary Examiner*—J. Howard Flint, Jr.
*Attorney, Agent, or Firm*—Karl W. Flocks

[57] ABSTRACT

A press for making castings of powder or granular materials, wherein a ram provided on a press frame, for the movement of a first press tool part, in particular an upper die, as well as a linkage provided on the press frame, for the movement of a second press tool part, in particular a mold, are guided movable in the same direction in relation to a clamping plate provided for the attachment of a third press tool part, in particular a lower die, and the ram is firmly connected to a ram traverse, through which, during an adjustable phase of its approach to the clamping plate, it transmits a movement produced by a driving device, in particular a toggle-lever drive, to a linkage traverse firmly connected to the linkage, the transmission being effected by means of a thrust piece which, in order to make possible a residual stroke of the ram for the purpose of secondary compression of the pressed casting, is deflected laterally when the linkage traverse reaches a predetermined final press position.

9 Claims, 16 Drawing Figures

PRESS FOR MAKING CASTINGS OF POWDER OR GRANULAR MATERIALS

BACKGROUND OF THE INVENTION

In a prior art press of this kind a wedge is provided as the thrust piece, which is guided with possibility of displacement of a vertical guide in parallel with the direction of movement of the ram traverse, driven by a toggle-lever drive, and of the linkage traverse and can be inserted transversely to such a direction of movement to a certain extent between the ram traverse and the linkage traverse; the greater the required residual stroke of the ram for the secondary compression of the casting the greater the depth of the insertion. In each working cycle of the known press the wedge is pressed downward by the ram traverse and, during this, it should press the linkage traverse downward initially by an identical amount. This means that the wedge may not slide out laterally from between the ram traverse and the linkage traverse. However, as soon as the linkage traverse reaches its final press position, a sliding surface formed on the lower side of the wedge contacts a stationary cross-bar and the wedge must then overcome a spring force which supports it and slide out laterally between the ram traverse and the stationary cross-bar, so that the ram traverse together with an upper die attached thereon may perform a downward residual stroke in which the linkage traverse and a mold attached thereon no longer participate. One is faced at least with difficulties when the spring force that supports the wedge laterally is to be selected so that, together with the friction effective between the wedge and the two-above mentioned traverses, it prevents a premature lateral deflection of the wedge, on the one hand, and, on the other hand, however, so that, together with the friction effective between the ram traverse, the stationary cross-bar and the wedge, it is not capable of preventing the lateral deflection of the wedge when it reaches the cross-bar.

In another prior art press of this type, the motions transmitted from the withdrawal cam and return stroke cam to the linkage are coupled through an infinitely adjustable differential gearing. The latter is associated with two bevel-gear segments that are mounted on the pivot pin of the lever pivoted on the press frame and connected to the linkage, the segments engaging a bevel pinion mounted between the segments on the lever. A bevel gear segment possesses a radial serration concentric with the pivot pin and meshing with a spur gear segment. The latter is attached to a shaft mounted in the press frame at a distance and parallel to the pivot pin of the lever, the shaft carrying a cam lever comprising a cam follower roll. The other bevel gear segment possesses a radial connecting link guide, which is engaged by a sliding block mounted on a carriage. The carriage can be displaced with the possibility of infinite variation along a lever that is attached on a second shaft and which is mounted in the press frame likewise at a distance and parallel to the pivot pin, coaxially to the first shaft which is mentioned above. Also, the second shaft carries a cam lever on which a cam follower roll is mounted. The two cam follower rolls are associated in each case with one of the two cams attached to the main shaft of the press. The lever connected to the linkage represents a balancing between the swinging movements of the two bevel-gear segments. When the two bevel-gear segments perform swinging movements of the same size and direction, such movements are transmitted in the full magnitude to the lever. By shifting the carriage together with the sliding block that engages the guide of a bevel-gear segment, the magnitude of the swinging movements of such a bevel gear segment can be varied at the given shape of the cam associated with the segment. Owing to the balancing effect of the bevel pinion, this produces the possibility of varying the total effect exerted by the two cams on the lever connected to the linkage. However, the effects of the two cams cannot be separated from each other, which makes it difficult to adjust the strokes of the linkage to the strokes of the ram and, since press tools vary, it is not possible to avoid a frequent replacement of the cams.

SUMMARY OF THE INVENTION

The invention is based on the task of developing further a press of the first previously described type so that the residual stroke of the ram, provided for the secondary compression of the pressed casting, is reliably controlled even under varying operational conditions.

Basically the invention solves the problem in such a manner that the thrust piece is mounted on one of the two traverses, that an abutment for the thrust piece is connected, adjustably in the direction of movement of the two traverses, to the other traverse, and that a diverter is arranged on the press frame, which diverter diverts the thrust piece from the abutment when the linkage traverse reaches the final press position.

This limits precisely the distance in which the thrust piece forces the linkage traverse to participate in the compression stroke of the ram traverse; independently of accidental variations in the friction value prevailing between the thrust piece and its abutment, the diverter makes certain that the thrust piece becomes ineffective precisely in the final press position of the linkage traverse, so that the ram traverse is reliably enabled to perform its residual stroke. Since the diverter, owing to its shape and arrangement on the press frame, necessarily acts on the thrust piece in the desired position of the ram stroke, the risk of an overloading of the press is at the same time reduced substantially.

In an expedient embodiment of the invention, the abutment is connected to the linkage traverse and the diverter is adjustable along a guide arranged on the press frame and parallel to the direction of movement of the two traverses, which diverter is connected to a setting mechanism that branches out from a common actuation device and during every actuation changes the relative position of the abutment in relation to the linkage traverse in the same direction and by the same amount as the position of the diverter on the press frame.

In the present invention the thrust piece, abutment and diverter are preferably arranged in pairs symmetrically in relation to a central plane of the press parallel to the direction of movement of the traverse.

The characteristics of the invention described in the above text may be combined in a press wherein the two abutments are arranged on an abutment carriage that is guided on the press frame, possesses a guide for the linkage traverse, and is connected thereto through a threaded spindle whose effective position may be varied.

In the embodiment just described the two diverters are preferably arranged on a common diverter carriage.

The invention relates further to a press for making castings of powder or granular materials, wherein a ram provided on a press frame, for the movement of a first tool part, in particular an upper die, as well as a linkage provided on the press frame, for the movement of a second tool part, in particular a mold, are guided movable in the same direction in relation to a clamping plate provided for the attachment of a third press tool part, in particular a lower die, and wherein a withdrawal cam as well as a return stroke cam are arranged on a shaft rotating synchronously with the drive of the ram, the cams acting in each case through a cam follower on a lever pivoted on the press frame and connected to the linkage, in which connection during evey working cycle of the press the withdrawal cam effects a withdrawal stroke of the linkage from a final press position of the linkage, away from the ram, and the return stroke cam then effects a return stroke of the linkage ending in a filling position.

Accordingly, the invention is also based on the further task of further developing a press of the type described at the outset and in the second instance of prior art so that the various strokes of the linkage can be adjusted in simple manner to each other and to the strokes of the ram and are then performed reliably even under high loads.

The invention solves the problem in such a manner that the two cam follower rolls are arranged in each case on a curved carriage which is displaceable along an arc-of-circle guide formed on the lever, and the withdrawal cam and/or the return stroke cam possesses an arc-of-circle portion which is eccentric in relation to the shaft and equal in radius to the radius of the circle along which the cam follower associated therewith slides or rolls during the displacement of the corresponding curved carriage and whose center in the angular position of the shaft, wherein the linkage assumes the final press position, coincides with the center of the arc-of-circle guide associated therewith.

This produces a compact arrangement and the motions derived by the cam followers from the cams associated therewith are transmitted to the lever through a short distance and yet in infinitely adjustable magnitude. The curved carriage and its guides formed on the lever may be subjected to high loads, without being subjected to a noteworthy wear, since they do not move in relation to each other during the normal operation. The effect of the withdrawal cam and/or the return stroke cam on the magnitude of the swinging movements of the lever may be varied in the final press position, without a change in the final press position and without the necessity of changing the angular position of the cam in question with respect to the shaft that drives the cam. Therefore, it is sufficient during the assembly of the press of the invention to attach the withdrawal cam and the return stroke cam once and for always on the shaft. When the user of the press has to produce a very great variety of castings he merely has to adjust the curved carriages in order to obtain the required withdrawal and return stroke motions of the linkage.

The two curved carriages could be clamped in their guides and after removing the clamps are displaceable by hand. However, an embodiment of the invention wherein each of the two curved carriages possesses a worm-gear serration that meshes with a worm mounted in the lever and connected to an adjusting device is particularly effective. Owing to the automatic locking of this worm pair, the curved carriage need no longer be firmly clamped, so that each curved carriage may be displaced at any time by simply turning the worm associated therewith.

Further, it is of advantage to associate additionally a stationary stroke-limiting cam with at least one of the curved carriages. The cam associated with the curved carriage in question may then produce considerable angular accelerations of the lever, without the possibility of long great displacements performed by the lever owing to tis mass inertia.

Furthermore, it is of advantage if the final press position of the linkage is fixed in a known manner through an additional cam and an additional cam follower roll rolling thereon. This arrangement produces a particular economy of space and weight, if the additional cam follower roll is mounted on the lever itself.

BRIEF DESCRIPTION OF THE DRAWING

The invention is explained more in detail in the following text by means of schematic drawings showing an exemplified embodiment wherein.

DESCRIPTION OF THE PREFERRED EMBODIMENTS

Figure 2:
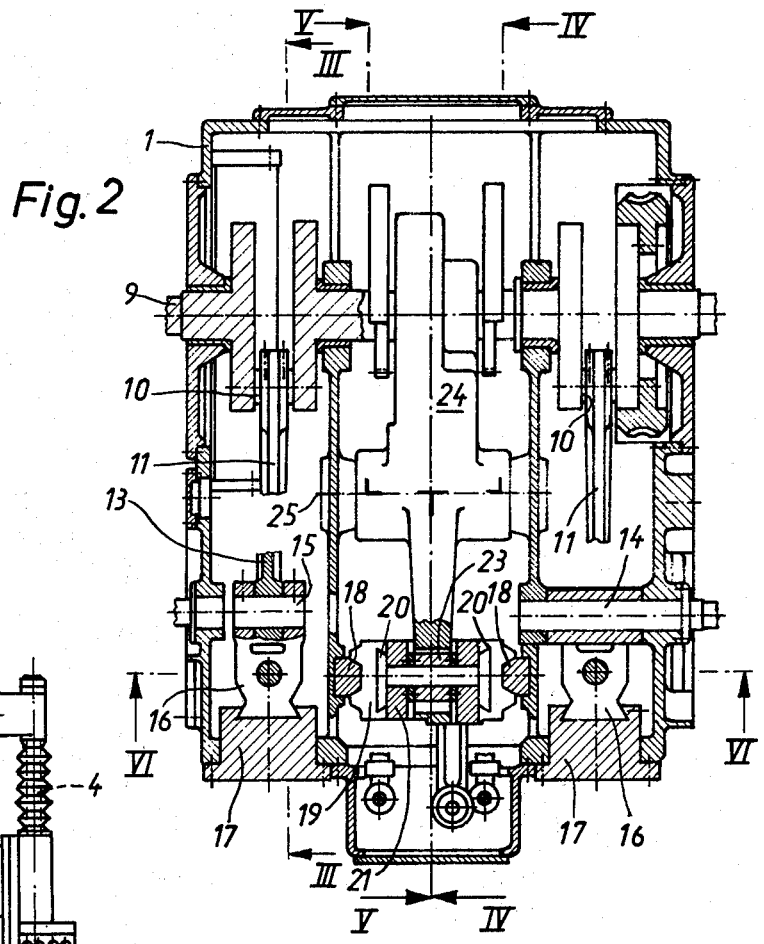
FIG. 2 shows a horizontal section through the press along the line II—II in FIG. 1, on an enlarged scale.
Figure 1:
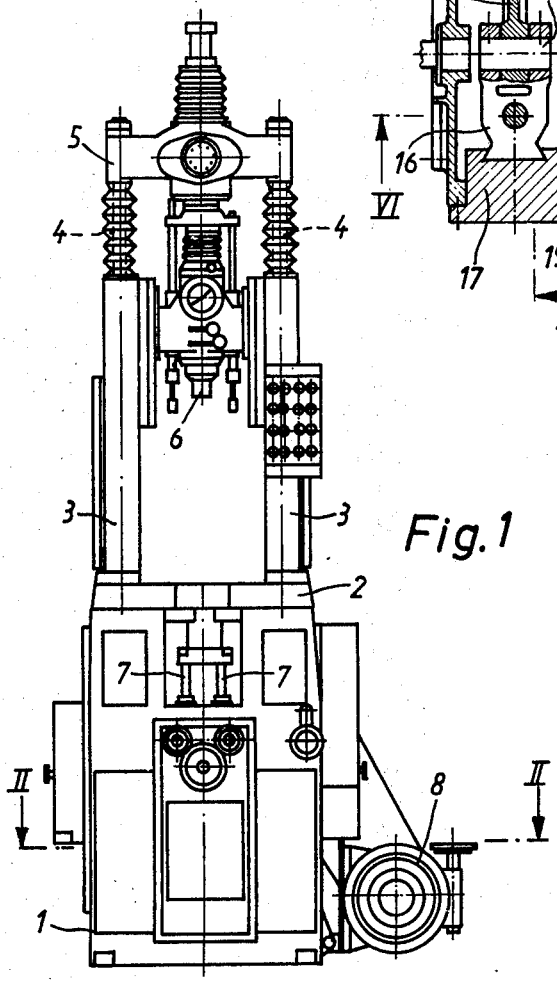
FIG. 1 shows a frontal elevation of a press of the invention.
Figure 3:
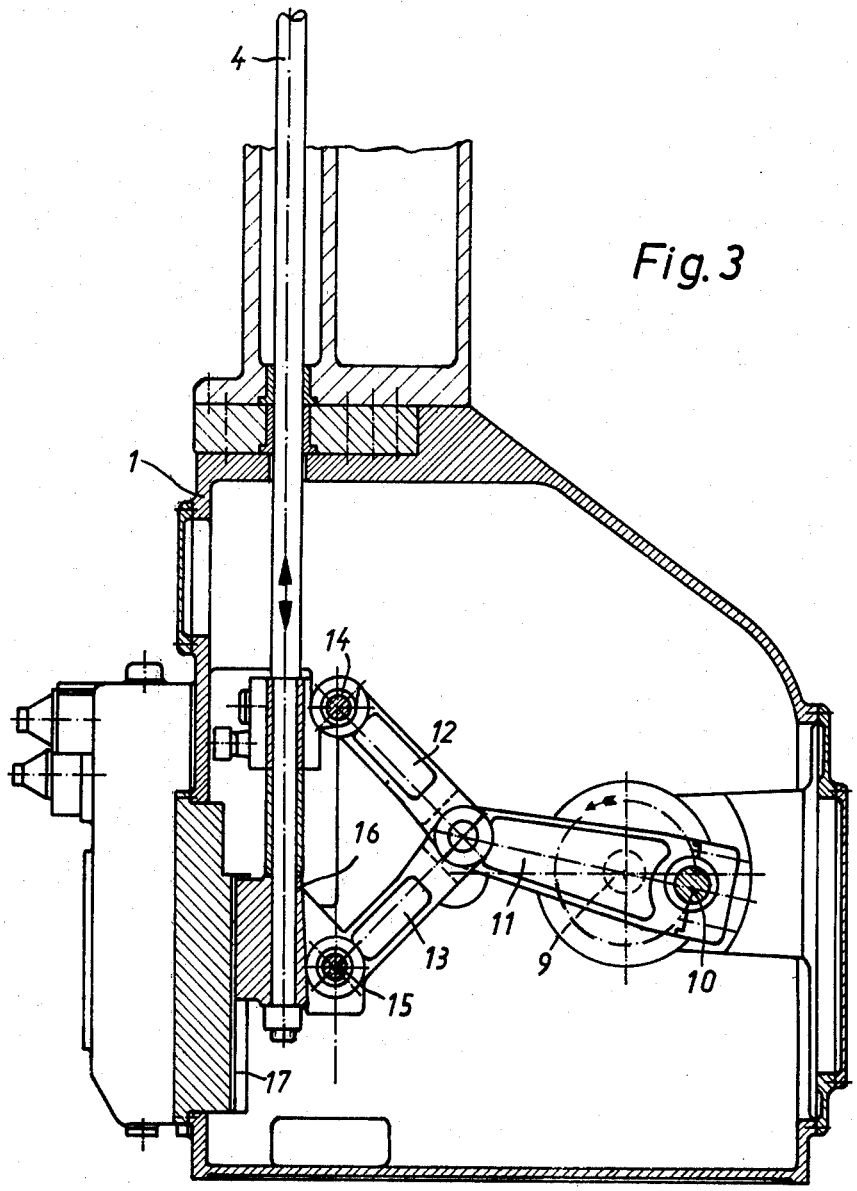
FIG. 3 shows a vertical section along the line III—III in FIG. 2.

The overall illustration of the press in FIG. 1 possesses a box-type press frame 1 as the supporting structure, the frame comprising a horizontal clamping plate 2 from which two columns 3 project vertically upward. A pull rod 4 is guided with possibility of vertical displacement in each column 3. The upper ends of two pull rods 4 are joined by a tie beam 5 that carries a ram 6. A linkage 7 vertically guided in press frame 1 ends below clamping plate 2. Clamping plate 2, ram 6 and linkage 7 are employed for attaching the reciprocally-movable parts of a known press tool for manufacturing castings of powder or granular material. A geared motor 8 is provided for producing upward and downward strokes of ram 6 and linkage 7.

Geared motor 8 drives a shaft 9, shown in FIGS. 2 to 5*a*, and consisting of a crankshaft comprising two identical cranks 10 pointing in the same direction and connecting rods 11 mounted thereon. According to FIGS. 2 and 3, each connecting rod 11 is connected to an upper arm 12 and a lower arm 13 of a toggle lever. Upper arms 12 of the two toggle levers ar mounted in each case on a pivot pin 14 attached in press frame 1. On the other hand, lower arms 13 of the two toggle levers are joined in each case by means of a pivot pin 15 to a ram traverse 16 that can be displaced along vertical guides 17 in press frame 1. Ram traverse 16 has the shape of an inverted U and is rigidly connected to tie beam 5 through both pull rods 4, so that ram 6 participates in the upward and downward movements of ram traverse 16.

Figure 6:
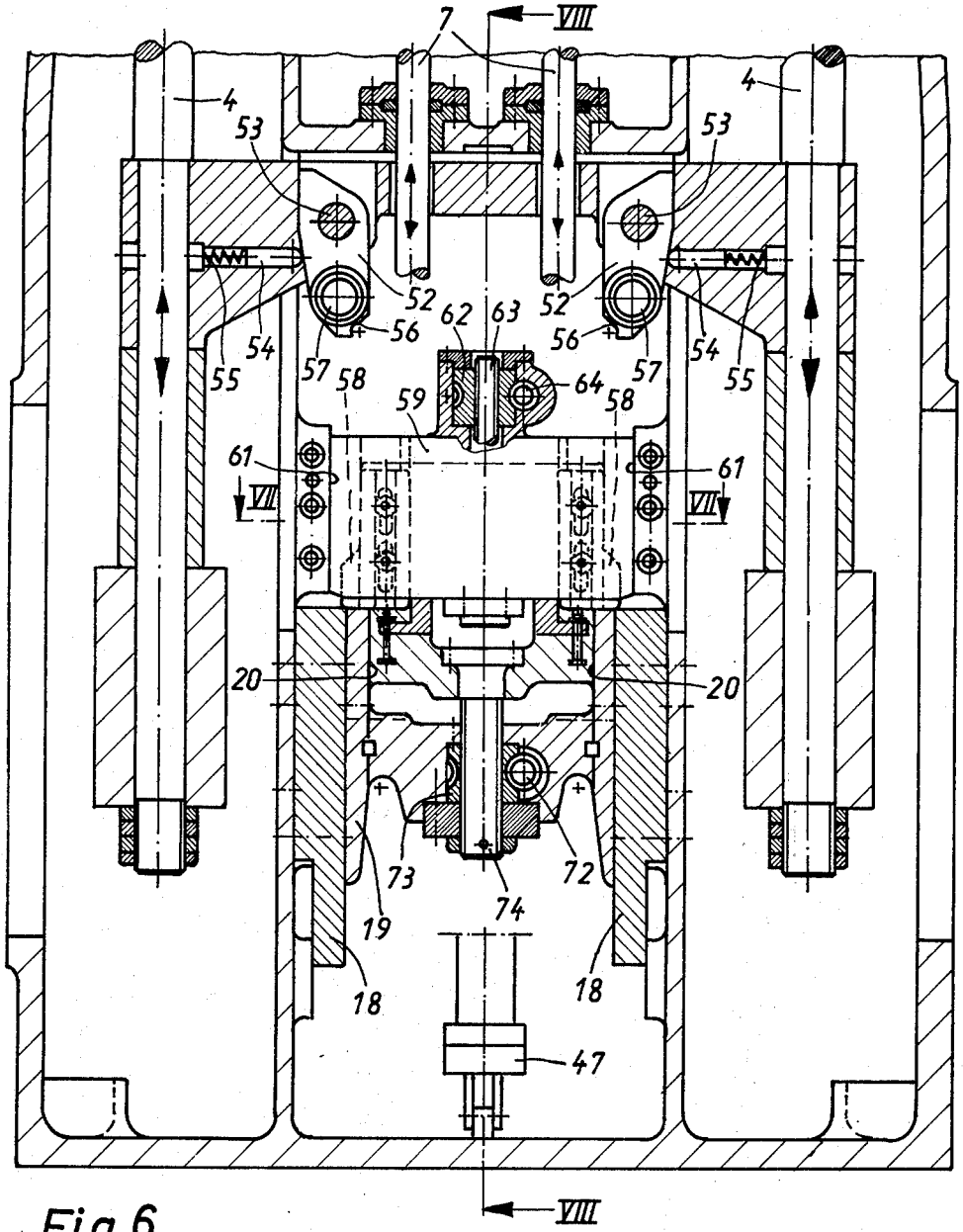
FIG. 6 shows a vertical section along the line VI—VI of FIG. 2, on an even larger scale.
Figure 7:
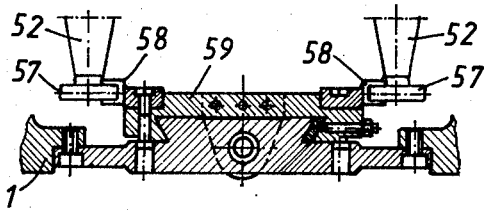
FIG. 7 shows a horizontal partial section along the line VII—VII of FIG. 6.
Figure 9:
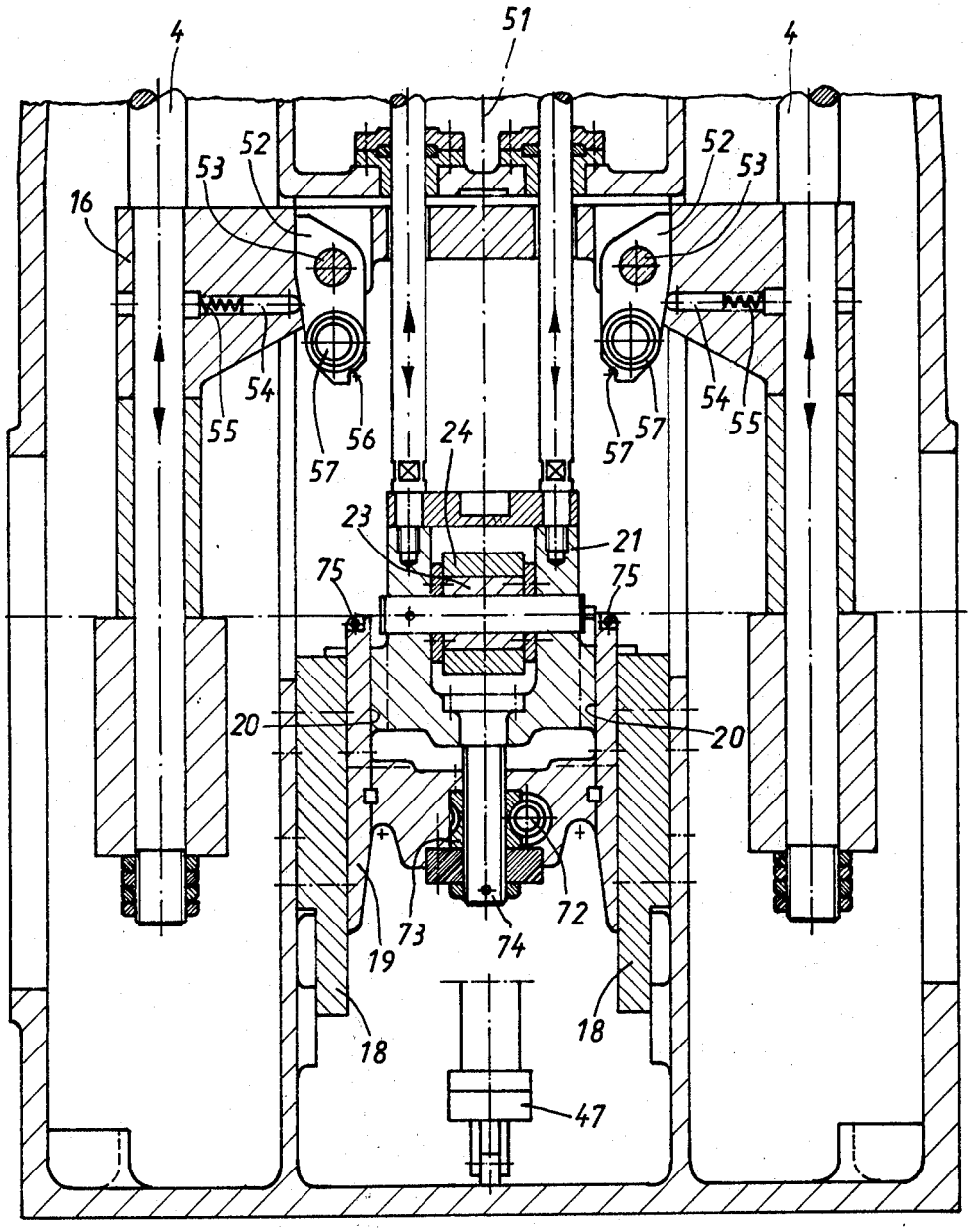
FIG. 9 shows a vertical section corresponding to FIG. 6; wherein separate parts are omitted.

In press frame 1 there are also formed vertical guides 18 for an abutment carriage 19, which has the shape of letter U recognizable above all in FIGS. 6 and 9, and it itself possesses vertical guides 20 for a linkage traverse 21 displaceable within abutment carriage 19 along the vertical. Linkage 7 is attached to linkage traverse 21, so that the press-tool part attached thereon participates in the upward and downward motions of the linkage traverse. The same is true also for a lifting rod 22, which is likewise attached to linkage traverse 21 and is guided in press frame 1. Its purpose is to impart upward and downward motions to a device that is not illustrated and that is used for filling a press tool with powder or granulate.

According to FIGS. 3 to 5a and 8, a sliding block 23 is mounted in linkage traverse 21, which block is guided with possibility of displacement at an end of a multi-arm lever 24. Lever 24 is mounted on a pivot 25 attached in press frame 1 in parallel with shaft 9. At its opposite end from its connection with sliding block 23, lever 24 is C-shaped and embraces with that end the shaft 9 in its central region situated between two cranks 10. The purpose of lever 24 is to impart a portion of the downward stroke (designated as withdrawal stroke hereinafter) to linkage traverse 21 during every working cycle of the press and, subsequently, to impart the entire upward-directed return stroke.

Figure 4:
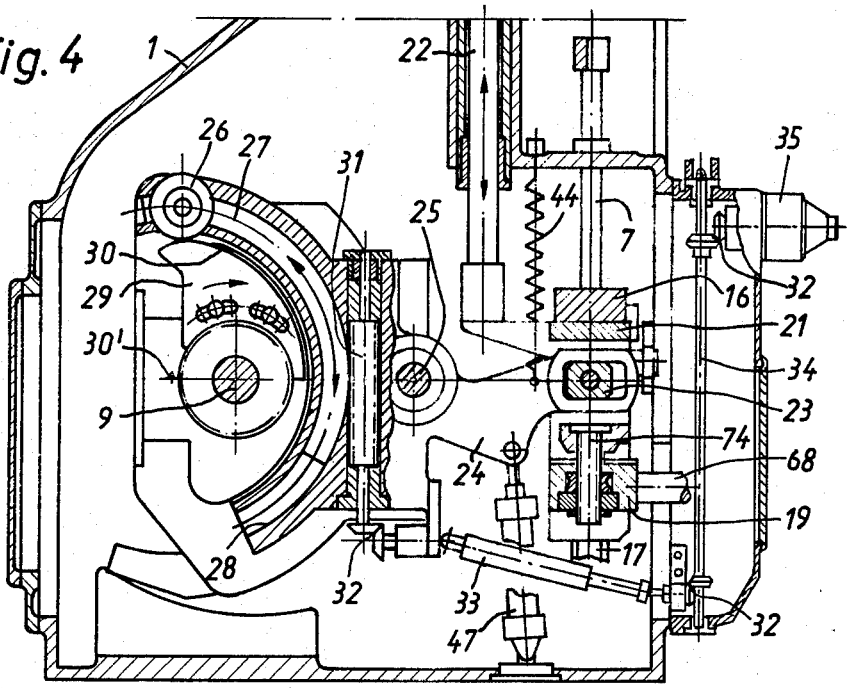
FIG. 4 shows a vertical section along the line IV—IV in FIG. 2, wherein the illustrated parts of the press assume its final press position.
Figure 4A:
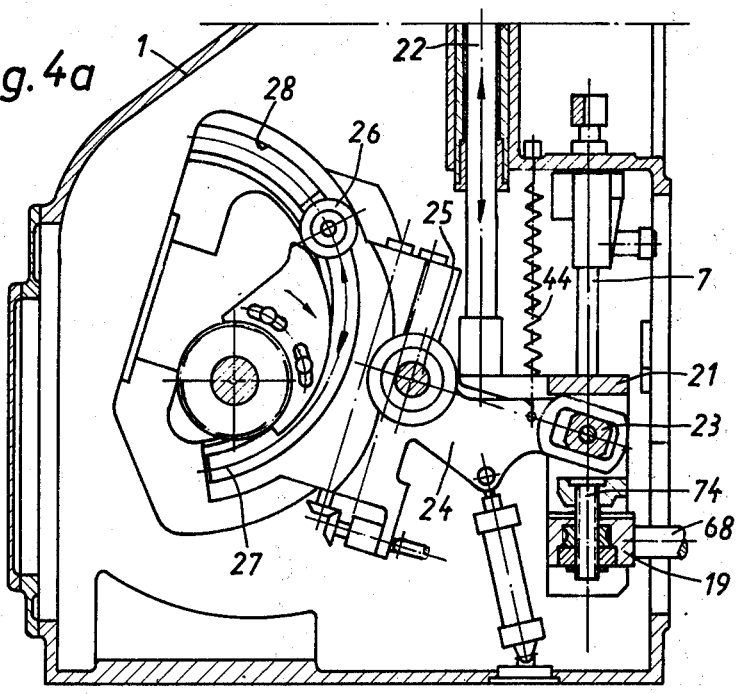
FIG. 4*a* shows a section corresponding to FIG. 4 in the withdrawal-end position of the illustrated parts.

According to FIGS. 4 and 4a, a cam follower 26 in the form of a roll is mounted so as to be rotatable on a first curved carriage 27, for the purpose of the withdrawal stroke, carriage 27 being displaceable along an arc-of-circle guide 28 provided on the C-shaped part of lever 24. Cam follower 26 is associated with a withdrawal cam 29 that is attached, adjustable in the direction of rotation, on shaft 9 and possesses an arc-of-circle section 30, whose radius is just as large as the radius of the circle on which cam follower 26 rolls, when curved carriage 27 is displaced along arc-of-circle guide 28. This feature is valid for any position of lever 24 and, accordingly, also for any position of linkage traverse 21.

FIG. 4 shows linkage traverse 21 in the final press position, i.e., the position reached by linkage between 21 toward the end of every pressing operation, where it normally remains for a short time before it reaches further down through a withdrawal movement, e.g., into the position seen in FIG. 4*a*. In the final press position, the axis of rotation of sliding block 23 of FIG. 4 is situated in the same horizontal plane as the geometric axis of shaft 9 and pivot 25 of lever 24. In the final press position, a center 30′ of arc-of-circle section 30 of withdrawal cam 29 is identical with the center of the arc of circle on which cam follower 26 rolls, when curved carriage 27 is displaced along arc-of-circle guide 28. Consequently, curved carriage 27 may be displaced as desired in the final press position, without any change in the angular position of lever 24 and, therewith, in the position of linkage traverse 21.

Arc-of-circle section 30 of withdrawal cam 29 is eccentric to a considerable extent in relation to shaft 9; in the final press position, center 30′ of FIG. 4 is situated on the side of shaft 9 which is turned away from pivot 25. Accordingly, also arc-of-circle guide 28 is eccentric in relation to shaft 9. Therefore, every displacement of curved carriage 27 along arc-of-circle guide 28 effects a change in the distance between cam follower 26 and shaft 9. In FIG. 4, curved carriage 27 is shown in a position wherein cam follower 26 is so distant from shaft 9 that withdrawal cam 29 is ineffective, since it is not able to displace cam follower 26; rather, it is merely able to contact it slightly without producing a swinging of lever 24. However, when curved carriage 27 is so displaced along arc-of-circle guide 28 that cam follower 26 approaches pivot 25, withdrawal cam 29 effects a pivoting of lever 24 during every revolution of shaft 9, e.g., into the position shown in FIG. 4*a*. During such a pivoting, linkage traverse 21 performs a downward withdrawal movement.

In order to displace curved carriage 27 along arc-of-circle guide 28, a worm 31 is mounted in lever 24, according to FIG. 4, which worm engages a worm-gear serration formed on the outer side of curved carriage 27 and is connected to a cardan shaft 33 by means of a miter gear 32 consisting of bevel pinions in the example shown, the cardan shaft being extensible in telescopic manner and itself connected, through a further miter gear 32 and an intermediate shaft 34 mounted vertically on press frame 1, to an adjustment device 35. The latter can, for example, be operated by means of a hand crank.

For the return stroke of linkage traverse 21, a second cam follower 36 is mounted on a second curved carriage 37, that is displaceable in an arc-of-circle guide 38. The latter is formed on lever 24 on the opposite side from arc-of-circle guide 28 in a plane parallel to the plane thereof. In the illustrated, preferred exemplified embodiment two arc-of circle guides 28 and 38 are non-overlapping in relation to each other. Cam follower 36 is associated with a return stroke cam 39 attached to shaft 9, which cam likewise possesses an arc-of-circle portion 40. A center 40′ of arc-of-circle portion 40 corresponds in the final press position of FIG. 5 to the center of the arc-of-circle on which cam follower 36 is rolling during a displacement of curved carriage 37. Consequently, also cam follower 36 may be displaced as desired in the final press position of FIG. 5, without any change in the angular position of lever 24.

Figure 5:
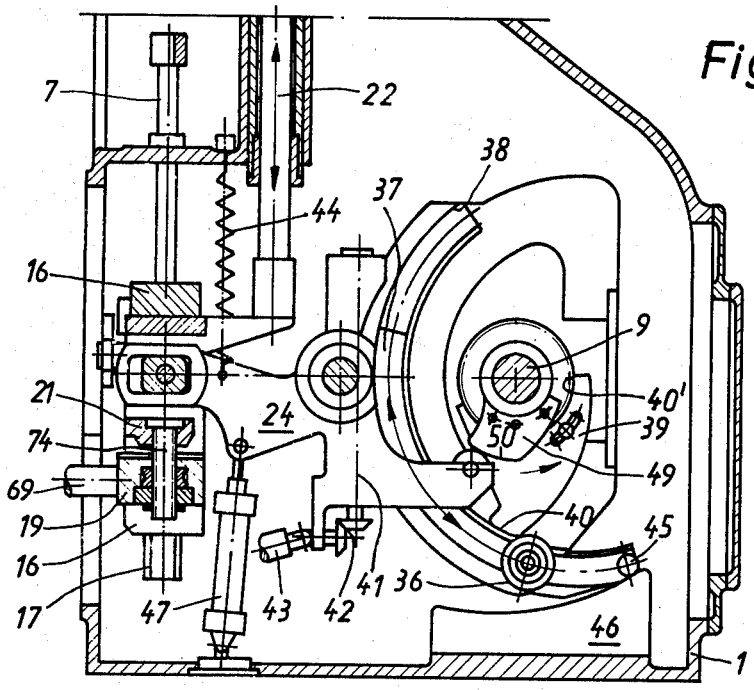
FIG. 5 shows a vertical section along the line V—V in FIG. 3, wherein the illustrated parts assume their final press position just as in FIG. 4.
Figure 5A:
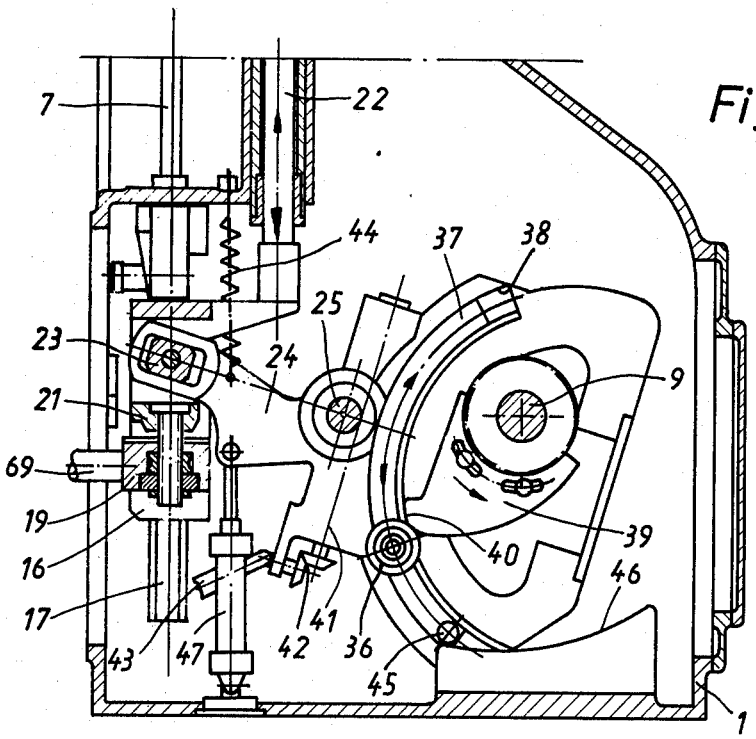
FIG. 5*a* shows a section corresponding to FIG. 5, in the filling position of the illustrated parts.

In FIG. 5, curved carriage 37 is so set in its arc-of-circle guide 38 that return stroke cam 39 at most slightly touches cam follower 36 and is thus ineffective. The consequence of a displacement in the case of curved carriage 37 is in principle the same as in the case of curved carriage 27. In FIG. 5*a*, curved carriage 37 is shown in an angular position wherein cam follower 36 must be displaced by return stroke cam 39 during every revolution of shaft 9, so that the return stroke cam produces a swinging of lever 24 during every revolution. Such a swinging effects a complete return stroke of linkage traverse 21 from the lowest position, corresponding, e.g., to FIG. 4*a*, to the highest position corresponding, for example, to FIG. 5*a*. The fact that return stroke cam 39 produces an upward directed movement of linkage traverse 21, while withdrawal cam 29 produces a downward directed movement, can be explained, on the one hand, by the arrangement of cam follower 36 in the lower quadrant of arc-of circle guide 38 associated therewith and, on the other hand, by the arrangement of cam follower 26 in the upper quadrant of arc-of-circle guide 28 associated therewith.

In order to displace curved carriage 37 along arc-of-circle guide 38, there is provided a device which corresponds to that used for the displacement of curved carriage 27 and likewise possesses a worm 21, which is merely indicated in FIGS. 5 and 5*a*, as well as a miter gear 42 and a cardan shaft 43 which is extensible in telescopic manner.

A return stroke spring 44 acts similarly to return stroke cam 39. It joins the end of lever 24 connected to linkage traverse 21 with a part of press frame 1 arranged thereabove, thus biasing it in the upward direction. The swinging of lever 24 in the direction wherein linkage traverse 21 moves upward is limited by a pin 45 that is attached to an extension of curved carriage 37 and abuts against a stationary stroke-limiting cam 46 having such an outline that cam follower 36 is able to follow the outline of return stroke cam 39 in any position of curved carriage 37, but without moving, under the action of return stroke spring 44 or inertia forces, noticeably away from shaft 9 beyond arc-of-circle portion 40 of return stroke cam 39.

In order to prevent an automatic lowering of linkage traverse 21, as soon as return stroke cam 39 with its arc-of-circle section 40 passes by cam follower 36, the end of lever 24 joined to linkage traverse 21 is supported on press frame 1 by means of a pneumatic piston-and-cylinder unit 47.

According to FIG. 5, an additional cam follower roll 48 is mounted on lever 24, which roll engages an additional cam 49 attached to shaft 9. Additional cam 49 possesses an arc-of-circle portion 50 concentric with shaft 9. In a certain portion of every revolution of shaft 9, cam 49 thus supports lever 24 and, therewith, linkage traverse 21 in the final press position, independently of the setting of cam followers 26 and 36.

Figure 8:
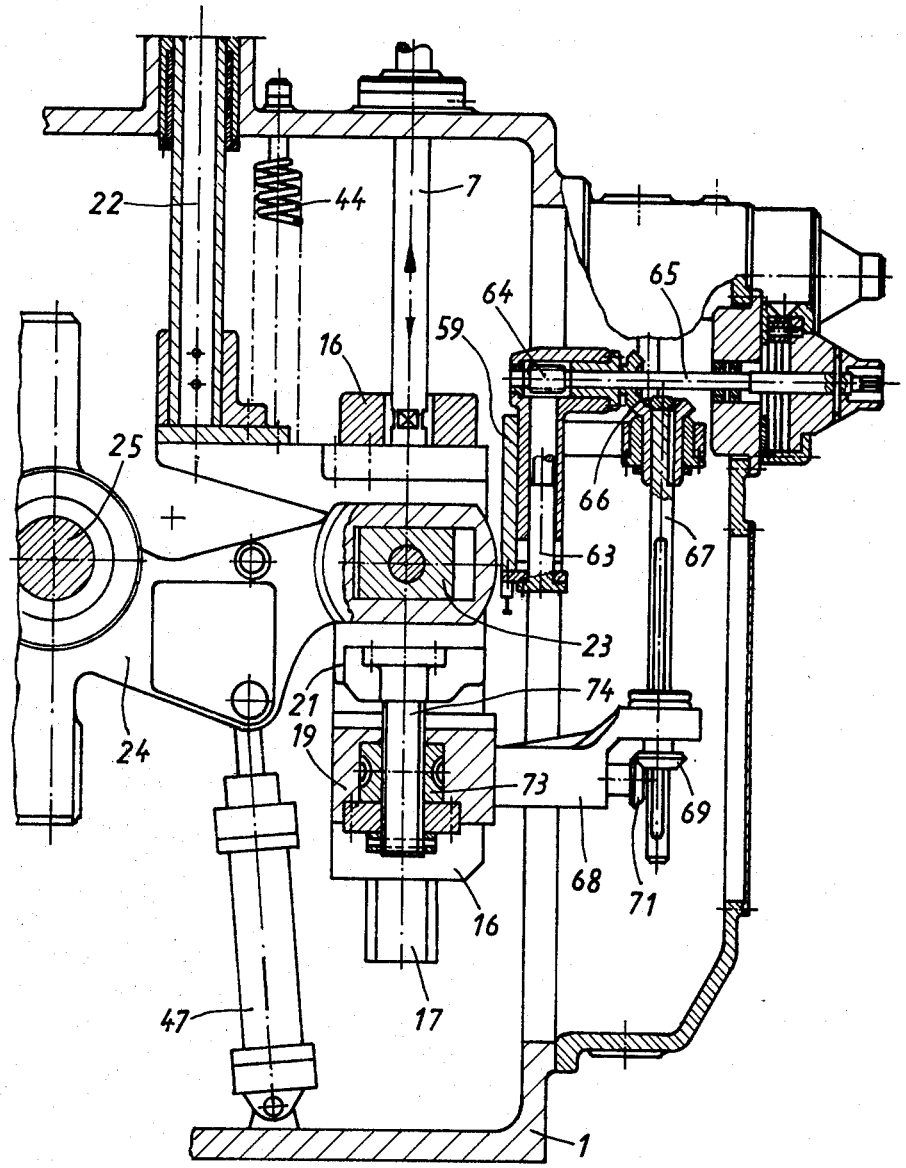
FIG. 8 shows a vertical partial section along the line VIII—VIII of FIG. 6.
Figure 9A:
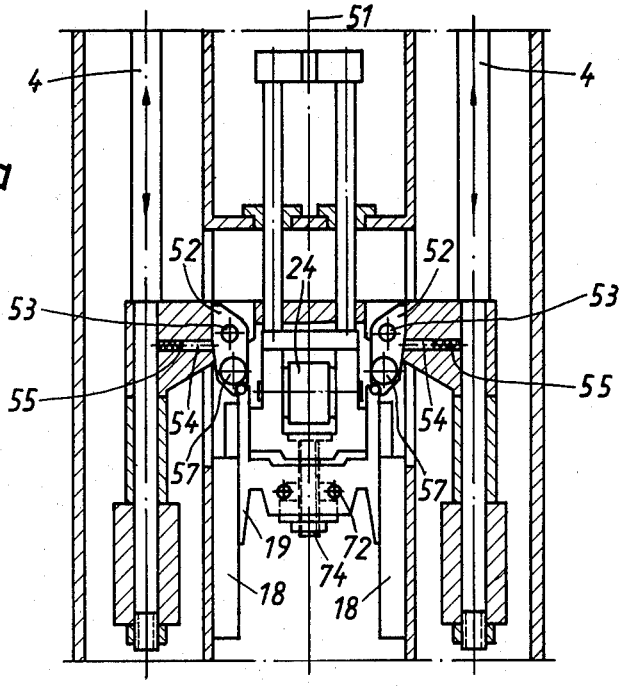
FIG. 9*a* shows a vertical section corresponding to FIG. 9 but drawn on a smaller scale and with greater simplicity, in a different operational position.

FIGS. 6 to 9*c* mainly show further details of ram traverse 16, abutment carriage 19 and linkage traverse 21, that are all shaped and arranged symmetrically to a central plane 51 of the press. Two thrust pieces 52 are thus pivoted in each case by means of a pin 53 on ram traverse 16. In FIGS. 6, 9 and 9*a* thrust pieces 52 assume an inner position fixed by stops and can be pivoted from such an inner position into an outer position in accordance with FIGS. 9*b* and 9*c*. Each thrust piece 52 is associated with a pin 54, which is guided displaceably in ram traverse 16 and supported by a restoring spring 55 in such a manner that it tries to keep the corresponding thrust piece in its inner position. Each thrust piece 52 possesses a shoulder 56 on the inner side of its lower end, a roll 57 being mounted in the vicinity of the shoulder.

Two diverters 58 are associated with both pivotable thrust pieces 52, which diverters are attached with possibility of adjustment on a diverter carriage 59 symmetrically in relation to central plane 51. Diverter carriage 59 is guided on vertical guides 61 on press frame 1 and can be displaced in the vertical direction. According to FIGS. 6 to 8, a nut-type worm gear 62 is mounted for such a purpose on press frmae 1 without possibility of axial displacement and screwed on a vertical spindle 63 attached without possibility of rotation on diverter carriage 59. Worm gear 62 is paired with a worm 64 likewise mounted in press frame 1 and attached on a horizontal shaft 65.

Horizontal shaft 65 is connected through a miter gear 66 consisting of bevel pinions to a vertical shaft 67, that is guided with possibility of axial displacement in an arm 68 projecting laterally from abutment carriage 19. A bevel pinion 69 is mounted on arm 68, which pinion is connected to vertical shaft 67 with possibility of axial displacement but without the possibility of rotation. Bevel pinion 69 meshes with a bevel pinion 71 of the same size, which is connected without possibility of rotation to a worm 72 mounted in abutment carriage 19. Worm 72 is paired with a nut-type worm gear 73, likewise mounted in abutment carriage 19 without possibility of axial displacement and screwed on a threaded spindle 74 rigidly attached on linkage traverse 21.

Figure 9B:
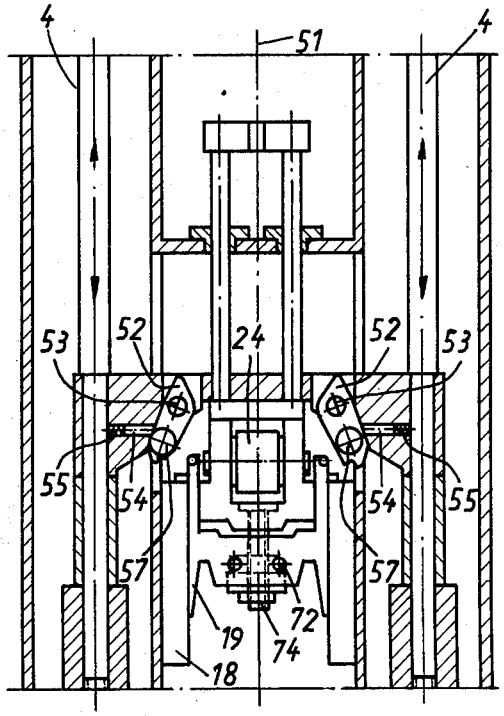
FIG. 9*b* shows a corresponding section in a further operational position.
Figure 9C:
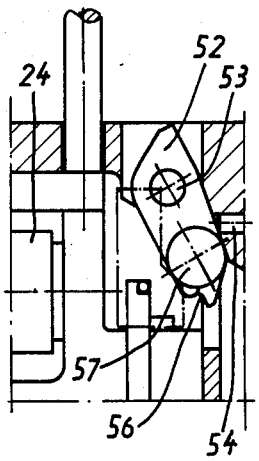
FIG. 9*c* shows an enlarged sector of FIG. 9*b;*

According to FIGS. 9 to 9*c*, two abutments 75, e.g., in the form of slender rolls of hardened steel, are firmly arranged on abutment carriage 19, likewise symmetrically in relation to central plane 51. Abutments 75 are associated with shoulders 56 of thrust pieces 52. The vertical distance between shoulders 56 and abutments 75 in the upper end position of ram traverse 16 and linkage traverse 21, shown in FIGS. 6 and 9, the so-called filling position, can be adjusted to a desired magnitude in such a manner that horizontal shaft 65, shown in FIG. 8, is turned, e.g., by means of a hand crank. In accordance with the direction of rotation, the turning of horizontal shaft 65 in a given position of linkage traverse 21 produces a lowering or lifting of abutment carriage 19 and at the same time a lowering or lifting of diverter carriage 59 by the same amount.

The higher the setting of abutment carriage 19 in relation to linkage traverse 21, the sooner thrust pieces 52 mounted on ram traverse 16 abut with their shoulders 56 against abutments 75 during the downward stroke of ram traverse 16, as shown in FIG. 9*a*. As soon as thrust pieces 52 establish a pressure-resistant connection between ram traverse 16 and abutment carriage 19, ram traverse 16 takes along abutment carriage 19 and, therewith, also moves linkage traverse 21 in a downward direction, until rollers 57 of thrust pieces 52 run onto diverters 58, owing to which thrust pieces 52 are swung into their outer position and thus rendered ineffective. Diverters 58 are arranged on diverter carriage 59 in such a manner as to make thrust pieces 52 always ineffective when linkage traverse 21 reaches its pressing position. The residual stroke is then performed by ram traverse 16 and ram 6 connected therewith, without any additional change in the position of linkage traverse 21, since the latter is supported by lever 24, additional cam follower roll 48 and additional cam 49 in the described manner at least until ram traverse 16 with ram 6 reaches its lower end position.

Figure 10:
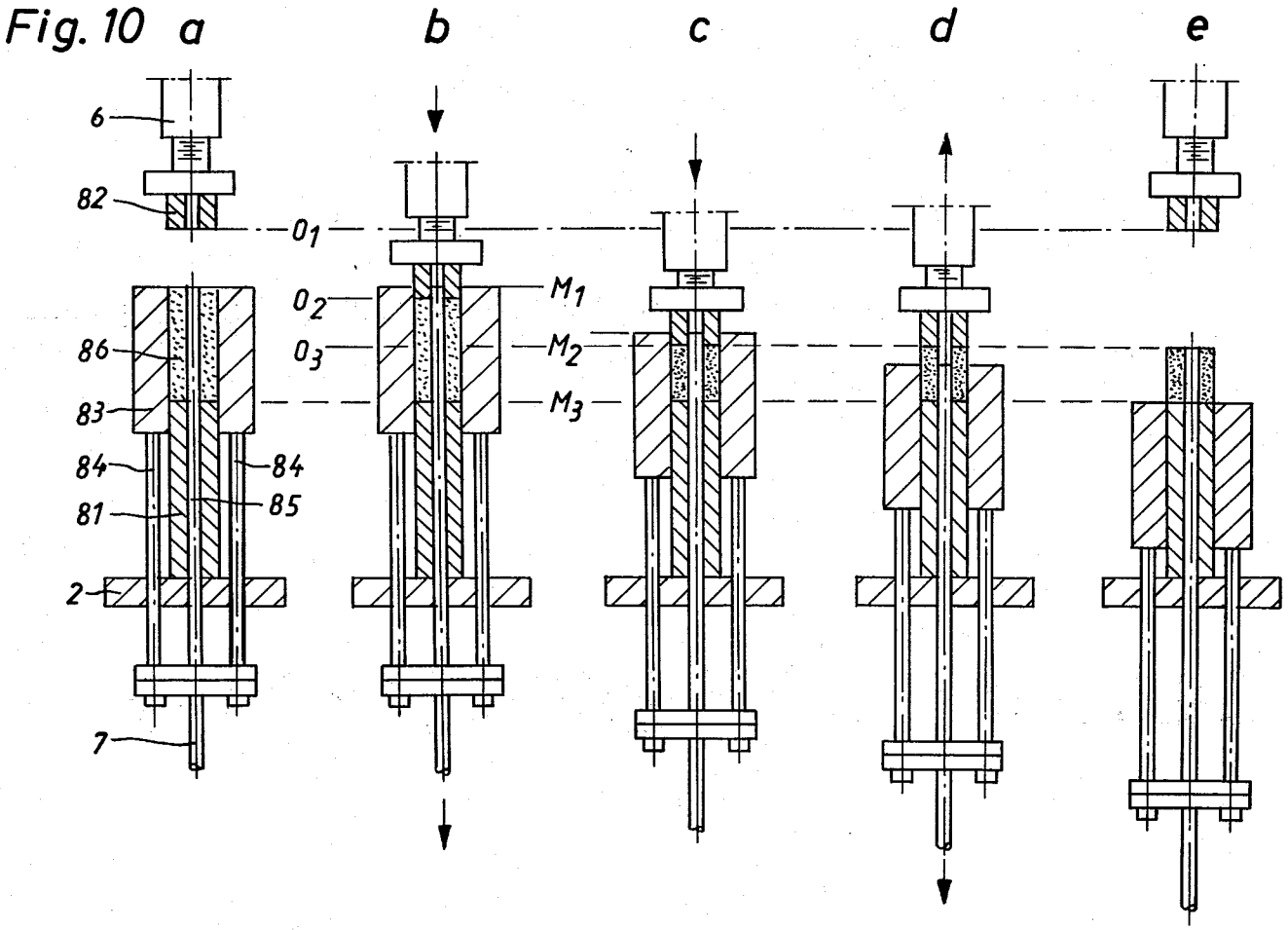
FIGS. 10*a* to 10*e* show a working cycle of the press when working without secondary compression.
Figure 11:
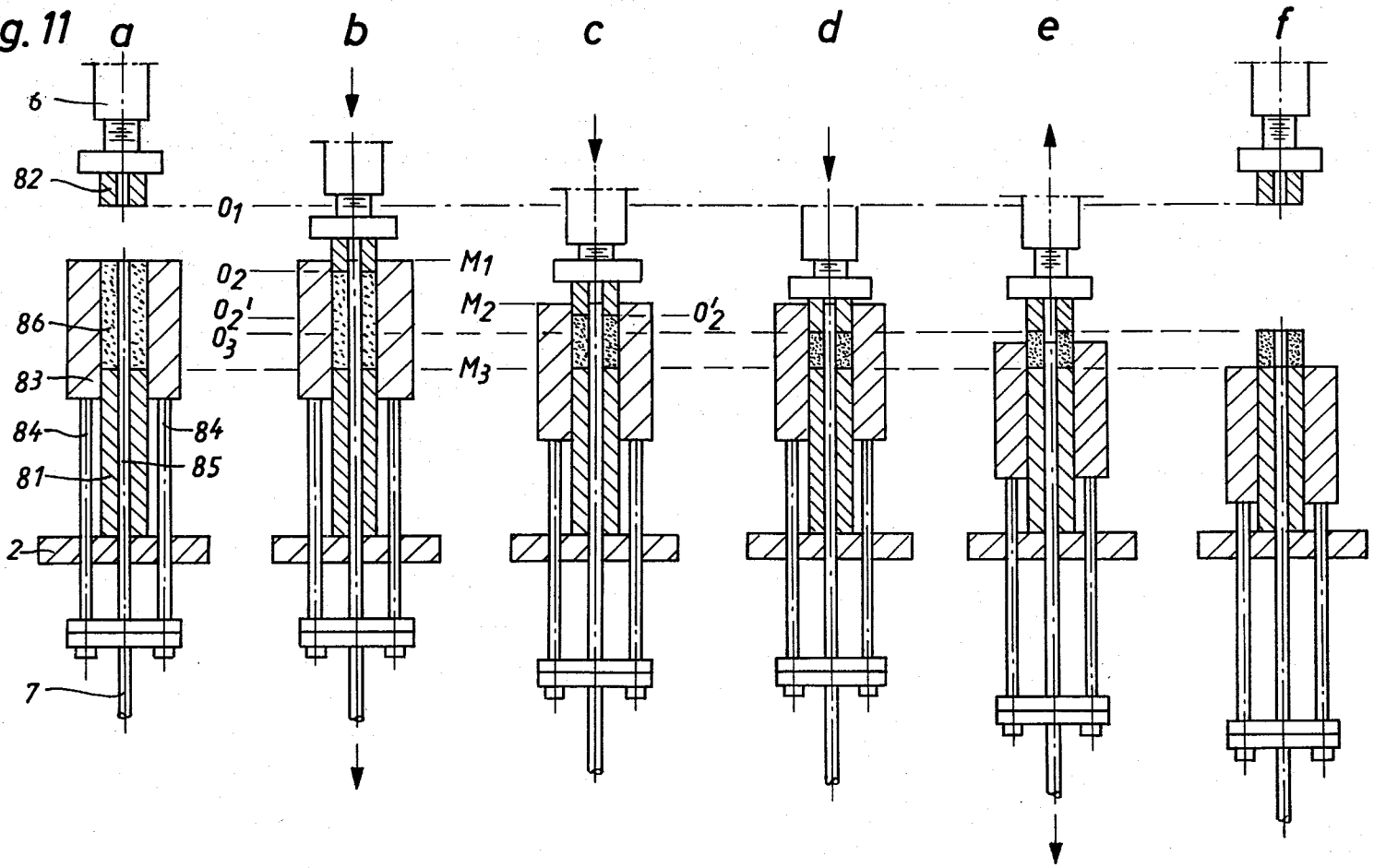
FIGS. 11*a* to 11*f* show a working cycle of the press when working with secondary compression.

The operation of the described press is explained in the following text by means of FIGS. 10 and 11, wherein the press is indicated only by the clamping plate 2, ram 6 and linkage 7. A lower die 81 is attached to clamping plate 2, an upper die 82 is attached to ram 6 and a mold 83 is attached to linkage 7, the connection between linkage 7 and mold 83 being established by means of connecting rods 84 that extend through clamping plate 2. Further, a mold die 85 is attached to linkage 7, which die extends through an axial bore in lower die 81 up to the upper face of mold 83 and can engage a corresponding bore of upper die 82.

In FIG. 10*a*, ram 6 assumes an upper end position, wherein the lower face of upper die 82 is situated in a plane $O_1$. At the same time, linkage 7 assumes its upper end position, the so-called filling position, wherein the upper face of mold 83 is situated in a plane $M_1$. The upper face of lower die 81 is and remains in a plane $M_3$. Mold 83 possesses a cavity between planes $M_3$ and $M_1$, which cavity according to FIG. 10*a* is filled with a powder 86 to be pressed.

Ram 6 with upper die 82 initially begins every downward stroke alone; during this stroke the lower face of upper die 82 reaches a plane $O_2$, according to FIG. 10b, which plane is situated somewhat lower than plane $M_1$, wherein the upper face of mold 83 still remains in its initial position. This means that upper die 82 plunges into mold 83 and that mold die 85 simultaneously engages the bore of upper die 82, so that the cavity of mold 83 is completely closed. In the operation shown in FIGS. 10*a* and 10*e* ram traverse 16 contacts linkage traverse 21 already in the working position of FIG. 10*b*, just as shown in FIG. 9*b*.

The operation in accordance with FIGS. 10*a* to 10*e* is continued in such a manner that ram 6 together with upper die 82 jointly with linkage 7 and mold 83 move downward until the lower face of upper die 82 reaches a plane $O_3$ and the upper face of mole 83 reaches plane $M_2$. For upper die 82, plane $O_3$ constitutes the lower end position and the compression of powder 86 is thus completed.

According to FIG. 10*d*, linkage 7 with mold 83 then begins its downward withdrawal movement, while ram 6 initially still remains in the position wherein the lower face of upper die 82 remains in plane $O_3$.

While linkage 7 with mold 83 continues the withdrawal movement up to plane $M_3$, ram 6 with upper die 82 returns into the upper end position, as shown in FIG. 10*e*. Mold 83 is now completely removed from the pressed casting, so that the latter can be transported away. Subsequently, linkage 7 with mold 83 return through a return stroke into the position of FIG. 10*a*.

The operational sequence described in the above text by means of FIGS. 10*a* and 10*e* can be modified according to FIGS. 11*a* to 11*f* in such a manner that a secondary compression takes place in addition to the compression obtained in FIG. 10*c*. The operational sequence shown in FIGS. 11*a* and 11*b* is the same as in FIGS. 10*a* to 10*b*. However, the joint downward movement of ram 6 with upper die 82 and linkage 7 with mold 83, which begins in the position of FIG. 11*b*, is not attained in such a manner that ram traverse 16 already contacts linkage traverse 21, but in such a manner that thrust pieces 52 with their shoulders 56 contact abutments 75. Ram traverse 16 thus presses abutment carriage 19 and, therewith, linkage carriage 21 from the position of FIG. 11*b* into the position of FIG. 11*c*, wherein the upper face of mold 83 indeed reaches plane $M_2$, just as in FIG. 10*c*, but the lower face of upper die 82 has not yet reached lowest possible position $O_3$; rather, it has merely reached intermediate position $O_2$.

The position of FIG. 11*c* is defined in such a manner that rolls 57 of thrust pieces 52 run onto diverters 58, so that shoulders 56 of the thrust pieces rebound off abutments 75. Then merely the ram with upper die 82 performs a residual stroke in a downward direction, until the lower face of upper die 82 reaches plane $O_3$ in accordance with FIG. 11*d*.

During such a residual stroke powder 86 is subjected to a secondary compression.

Subsequently, mold 83 begins its withdrawal movement in accordance with FIG. 11*e*, while upper die 82 initially still remains in plane $O_3$.

While mold 83 completes its withdrawal movement and reaches plane $M_3$ with its upper face, ram 6 with upper die 82 returns in accordance with FIG. 11*f* into the upper end position. Just as in FIG. 10*e*, the pressed casting may be removed and linkage 7 with mold 83 then performs its return stroke into the position of FIG. 11*a*.

It will be obvious to those skilled in the art that various changes may be made without departing from the scope of the invention and the invention is not to be considered limited to what is shown in the drawings and described in the specification.

What is claimed is:

1. A press for making castings of powder or granular material comprising a press frame, a ram connected to said press frame, a first press tool part including an upper die connected to said ram for movement therewith, linkage also connected to said press frame, a second press tool part including a mold connected for movement by said linkage, a clamping plate, a third press tool part including a lower die, said upper die and said mold movable in the same direction in relation to said lower die, a ram traverse having said ram connected thereto a driving device including a toggle-lever drive producing a movement transmitted by said ram through said ram traverse during an adjustable phase of its approach to said clamping plate, a linkage traverse firmly connected to said linkage, a thrust piece effecting the transmission of said driving device to said linkage traverse which in order to make possible a residual stroke of said ram for the purpose of secondary compression of the pressed casting, is deflected laterally when said linkage traverse reaches a predetermined final press position, said thrust piece being mounted on one of said two traverses, an abutment for said thrust piece connected, adjustably in the direction of movement of said two traverses, to the other of said two traverses, a diverter located on said press frame to divert said thrust piece from said abutment when said linkage traverse reaches a final press position.

2. A press as in claim 1, further characterized in that said abutment is connected to said linkage traverse and said diverter is adjustable along a guide on said press frame, said guide being parallel to the direction of movement of said two traverses, and said diverter being connected to a setting mechanism that branches out from a common operation device and on every actuation, changes the relative position of said abutment in relation to said linkage traverse in the same direction and by the same amount as the position of said diverter on said press frame.

3. A press as in claim 1, further characterized in that said thrust piece, said abutment and said diverter are arranged in pairs symmetrically in relation to a central plane of said press, which plane is parallel to the direction of movement of said traverses.

4. A press as in claim 2, further characterized in that said abutments are a plurality of stops which are arranged on an abutment carriage, which is guided on said press frame, possesses a guide for said linkage traverse, and is connected to the latter by means of a threaded spindle whose effective length can be changed.

5. A press as in claim 4, further characterized in that said diverter and another diverter are arranged on a diverter carriage.

6. A press for making castings of powder or granular material comprising a press frame, a ram connected to said press frame, a first press tool part including an upper die connected to said ram for movement therewith, linkage also connected to said press frame, a second press tool part including a mold connected for movement by said linkage, a clamping plate, a third press tool part including a lower die, said upper die and said mold movable in the same direction in relation to said lower die, a withdrawal cam and a return stroke cam arranged on a shaft for rotating synchronously with the drive of said ram, a cam follower on a lever for each of said cams, pivoted on said press frame and connected to said linkage, wherein during every working cycle of the press said withdrawal cam effects a withdrawal stroke of said linkage from a final press position of said linkage, away from said ram, and said return stroke cam then effects a return stroke of said linkage ending in the filling position, each said cam followers including a roll arranged on a curved carriage which is displaceable along an arc-of-circle guide formed on a lever, and at least one of said cams possessing an arc-of-circle portion which is eccentric in relation to said shaft and equal in radius to the radius of the circle along which said cam follower associated therewith moves during displacement of said curved carriage associated therewith and whose center in the angular position of said shaft wherein said linkage assumes the final press position coincides with the center of said arc-of-circle guide associated therewith.

7. A press as in claim 6, further characterized in that each of said two curved carriages possesses a wormgear serration, that meshes with a worm mounted in said lever and is connected to an adjustable device.

8. A press as in claim 6, further characterized in that a stationary stroke-limiting cam is associated with at least one of said curved carriages.

9. A press as in claim 6, wherein the final press position of said linkage is fixed by an additional cam attached on said shaft and an additional cam follower roll rolling thereon, said additional cam follower roll being mounted.

* * * * *